US009441386B2

(12) United States Patent
Buckingham et al.

(10) Patent No.: US 9,441,386 B2
(45) Date of Patent: Sep. 13, 2016

(54) JACKING POLE

(71) Applicants: Mark Allen Buckingham, Bernville, PA (US); Jamin Ray Buckingham, Bernville, PA (US)

(72) Inventors: Mark Allen Buckingham, Bernville, PA (US); Jamin Ray Buckingham, Bernville, PA (US)

( * ) Notice: Subject to any disclaimer, the term of this patent is extended or adjusted under 35 U.S.C. 154(b) by 46 days.

(21) Appl. No.: 14/612,362

(22) Filed: Feb. 3, 2015

(65) Prior Publication Data

US 2015/0144854 A1 May 28, 2015

Related U.S. Application Data

(63) Continuation of application No. 13/316,965, filed on Dec. 12, 2011, now Pat. No. 8,973,899.

(51) Int. Cl.
*E04G 25/06* (2006.01)
*E04G 25/04* (2006.01)

(52) U.S. Cl.
CPC ..... *E04G 25/061* (2013.01); *E04G 25/065* (2013.01); *E04G 2025/047* (2013.01)

(58) Field of Classification Search
CPC ..... B66F 1/06; B66F 1/08; B66F 3/38; B66F 7/10; B66F 2700/05; B66B 8/0853; B66B 9/04
See application file for complete search history.

(56) References Cited

U.S. PATENT DOCUMENTS

| | | | | |
|---|---|---|---|---|
| 2,215,759 | A | 9/1940 | Koehler | |
| 3,350,120 | A | 10/1967 | Hinrichs | |
| 3,918,108 | A | 11/1975 | Feyerherm | |
| 4,111,408 | A | 9/1978 | Love | |
| 4,122,645 | A | 10/1978 | Tooley | |
| 4,508,467 | A | 4/1985 | Choffin | |
| 5,413,436 | A | 5/1995 | Merz | |
| 5,810,333 | A | 9/1998 | Hickerson et al. | |
| 5,826,847 | A | 10/1998 | Warner et al. | |
| 6,042,066 | A | 3/2000 | Maharg et al. | |
| 6,364,270 | B1 | 4/2002 | Kamei | |
| 6,746,183 | B1 | 6/2004 | Sullivan | |
| 7,290,742 | B2 | 11/2007 | Wang | |
| 7,311,294 | B1 | 12/2007 | Ruan | |
| 7,857,287 | B2 | 12/2010 | Rucks | |
| 7,878,482 | B2 | 2/2011 | Hernandez, Jr. | |
| 8,033,527 | B2 | 10/2011 | Pasto | |
| 8,201,807 | B2 | 6/2012 | Hernandez, Jr. | |
| 8,820,713 | B2 | 9/2014 | Huang | |
| 8,973,899 | B2 * | 3/2015 | Buckingham | E04G 25/061 254/105 |
| 2013/0146825 | A1 * | 6/2013 | Buckingham | E04G 25/061 254/105 |
| 2015/0144854 | A1 * | 5/2015 | Buckingham | E04G 25/061 254/93 R |

* cited by examiner

*Primary Examiner* — Lee D Wilson

(74) *Attorney, Agent, or Firm* — Maier & Maier, PLLC

(57) ABSTRACT

A jacking pole apparatus is disclosed. A jacking pole may include two tubular members, slidably engaged with one another in such a manner that they may extend or expand. A jacking pole may engage two surfaces or objects and extend therebetween in order to provide support. Further, a jacking pole may vertically displace an object or surface. A jacking pole utilizes locking mechanisms to remain in certain positions and provide continuous support for surface and objects. The locking mechanisms may also be utilized during vertical displacement in order to facilitate such motion.

19 Claims, 2 Drawing Sheets

JACKING POLE

BACKGROUND

During construction it is often desirable to utilize temporary supports and scaffolding. These supports may allow concrete to dry, forms to be set, or otherwise provide temporary support until a certain object or structure can be secured. In some situations it is desirable to not only support a structure or object, but to also lift a structure or object. Further, in a construction setting it is desirable to have a simple, yet effective device to accomplish these tasks. Specifically, it may sometimes be desirable to have a compact, expandable device which may provide support or lifting force.

There are many supportive and jacking devices in the arts, however, many of these devices require extensive set up and complex parts. Further, many of the current solutions require extensive space in order to set up or utilize the device and may only extend a small percentage of their overall length. Thus, a compact, simple, and effective device for supporting and lifting surfaces and objects is desired.

SUMMARY

According to one exemplary embodiment, an extensible pole may be disclosed. An extensible pole may include a first member slidably engaged within a substantially hollow second member. At least one hole may be disposed transversely in the first member and the second member. An extensible pole may further include a locking mechanism. The locking mechanism may be configured to removably engage the second member and at least one hole disposed in the first member. This may restrict the sliding of the first member within the second member. An extensible pole may further include a jacking member, which may effectuate sliding of the first member in relation to the second member.

According to another exemplary embodiment, an extensible pole may include a first member slidably engaged with a second member, so as to extend therefrom. Both members may have at least one transversely disposed hole. An extensible pole may further have a locking mechanism, which may restrict the sliding of the first member within the second member, in at least one direction. The locking mechanism may removably engage the at least one hole disposed in the first member or the at least one hole disposed in the first member and the at least one hole disposed in the second member.

BRIEF DESCRIPTION OF THE DRAWINGS

Advantages of embodiments of the present invention will be apparent from the following detailed description of the exemplary embodiments. The following detailed description should be considered in conjunction with the accompanying figures in which.

DETAILED DESCRIPTION

Aspects of the present invention are disclosed in the following description and related figures directed to specific embodiments of the invention. Those skilled in the art will recognize that alternate embodiments may be devised without departing from the spirit or the scope of the claims. Additionally, well-known elements of exemplary embodiments of the invention will not be described in detail or will be omitted so as not to obscure the relevant details of the invention.

As used herein, the word "exemplary" means "serving as an example, instance or illustration." The embodiments described herein are not limiting, but rather are exemplary only. It should be understood that the described embodiments are not necessarily to be construed as preferred or advantageous over other embodiments. Moreover, the terms "embodiments of the invention", "embodiments" or "invention" do not require that all embodiments of the invention include the discussed feature, advantage, or mode of operation.

Generally referring to FIGS. 1-5, jacking pole 100 may be shown. Jacking pole 100 may include an inner support member and an outer support member, wherein the support members may be slidably engaged with each other in order to form an extensible pole. For example, an inner support member may telescope from within outer support member in order to expand. In some exemplary embodiments, jacking pole 100 may, at its ends, engage two surfaces or objects and extend therebetween in order to "shore" or provide additional support to these surfaces or objects. Further, jacking pole 100 may be extensible or extendable such that it may lift or "jack" a surface or object.

In some exemplary embodiments, jacking pole 100 may be disposed in a substantially vertical position, but it is recognized that jacking pole 100 may be used in a variety of dispositions. In FIGS. 1-5, jacking pole 100 is depicted in a vertical position wherein jacking pole 100 may be discerned to have a top and bottom. However, in some exemplary embodiments, the top of jacking pole 100, as it appears in FIGS. 1-5, may not actually be disposed above the bottom. Instead, jacking pole 100 may be used in a horizontal fashion, such that the "top" is disposed at either the right or left edge of jacking pole 100. Further, jacking pole 100 may also be used in an upside down disposition such that the "top" of jacking pole 100 may actually be disposed closest to a lower surface, such as the ground. However, in the interest of clarity, jacking pole 100 may be described in the vertical position depicted in FIGS. 1-5, such that it may have a top and bottom, regardless of the various dispositions which jacking pole 100 may actually be utilized in. Specifically, for the purposes of this specification, the upper most edge of jacking pole 100 as viewed in FIGS. 1-5 will be referred to as the top, while the lowermost edge of jacking pole 100 in FIGS. 1-5 will be referred to as the bottom.

Figure 1:
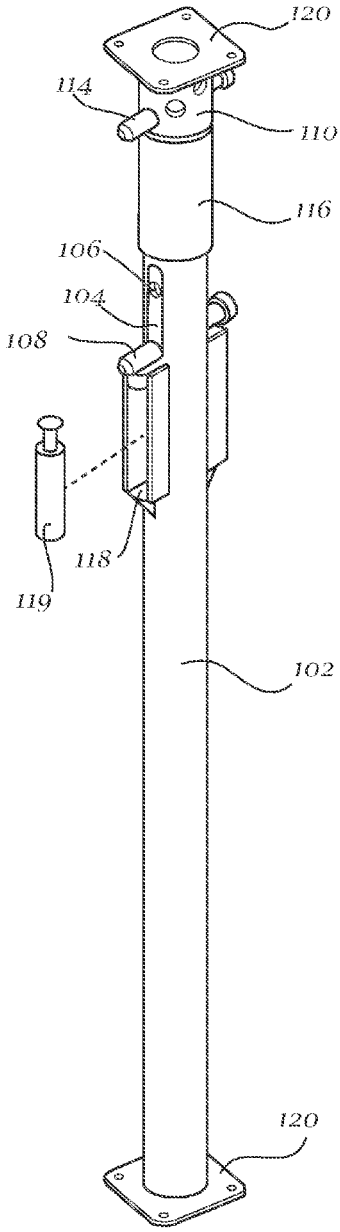
FIG. 1 is an exemplary orthogonal view of a jacking pole.

Now referring to FIG. 1, jacking pole 100 may include an outer support member 102 and an inner support member 104. Support members 102 and 104 may be structural components of any desirable shape or size. Support members 102 and 104 may, for example, be tubular members with circular cross sections. However, in alternate exemplary embodiments, support members 102 and 104 may be tubular members with cross sections shaped in any desirable manner, such as rectangular, hexagonal, or triangular. Support members 102 and 104 may be of any desirable length, such as between approximately three and approximately twenty-five feet long and may be manufactured from any desirable material. For example, support members 102 and 104 may be made of any hard supportive material known in the art, such as aluminum, alloy, wood, composites, plastic, or some combination thereof.

In addition to the aforementioned properties, inner support member 104 may also include holes 106 substantially spaced along the length of inner support member 104. Holes 106 may include any desirable number of holes, of any desirable diameter, in any desirable configuration. For example, holes 106 may include two sets of approximately one inch diameter holes aligned in substantially vertical columns disposed on opposite sides of inner support member 104, such that a locking mechanism, such as pin 108, may horizontally pass through a pair of holes 106 simultaneously. In such an embodiment, holes 106 may be spaced approximately one inch apart from each other.

Similarly, outer support member 102 may also include additional features. For example, outer support member 102 may have a portion of its exterior threaded and may include recesses and openings on its outer surfaces. For example, outer support members may include openings 103, which may be any desirable number of openings, of any desirable shape and size, disposed in any desirable location, such as two ovular slits, having major axes which may range from approximately four inches to approximately twenty-four inches, disposed substantially opposite each other, such that a locking mechanism, such as pin 108 may engage holes 106 through openings 103.

In certain exemplary embodiments, inner support member 104 may slidably engage outer support member 102 interiorly. Thus, inner support member may have a diameter or width which is smaller than the diameter or width of outer support member 102. For example, in an exemplary embodiment where both support members 102 and 104 are tubular members, inner support member 104 may have an outer diameter slightly smaller than the inner diameter of outer support member 102. In alternate exemplary embodiments, inner support member 104 may be a tubular member with a square cross section while outer support member 102 may be a tubular member with a circular cross section. In this exemplary embodiment, the corners of inner support member 104 may substantially engage the inner face of outer support member 102, such that inner support member 104 may slidably engage outer support member 102. In yet another exemplary embodiment, inner support member 102 may have an outer diameter substantially smaller than the inner diameter of outer support member 104 such that inner support member 102 may slide within outer support member 104 without contacting outer support member 104.

Still referring to the exemplary embodiment depicted in FIG. 1, jacking pole 100 may include sliding collar 110. Sliding collar 110 may also be a structural component of any desirable shape or size. Sliding collar 110 may, for example, be a tubular member with a circular cross section. In some exemplary embodiments, sliding collar 110 may have a cross sectional shape substantially similar to outer support member 102, such that the interior of sliding collar 110 may slidably engage the exterior of inner support member 104. Sliding collar 110 may be of any desirable length, such as any length within a range of approximately four inches to approximately twenty four inches, and may be manufactured from any desirable material. For example, sliding collar 110 may be made of any hard supportive material known in the art, such as aluminum, alloy, wood, composites, plastic, or some combination thereof.

Further, sliding collar 110 may contain a variety of holes 112. Holes 112 may include any desirable number of holes of any desirable shape and size. Holes 112 may be disposed at any desirable location, in any desirable configuration. For example, holes 112 may include eight holes disposed in such a manner that each hole has a matching or corresponding hole allowing a locking mechanism, such as pin 114, to substantially pass through sliding collar 110. In such an exemplary configuration, eight holes 112 may provide four different locations for a locking mechanism, such as pin 114, to pass through sliding collar 110. In this exemplary embodiment, each pair of holes 112 may be placed at approximately one inch vertical increments along the length of sliding collar 110. In alternate exemplary embodiments, holes 112 may be disposed in any position to allow a locking mechanism, such as, but not limited to a pin, rod, or other such device of any desirable size or shape to pass through sliding collar 110 at any desirable angle or position. In some exemplary embodiments, both pin 114 and 108 may be any desirable item, such as rods, pins, bolts, or clamps which may accomplish any tasks associated with pins 108 and 114, such as, but not limited to, bearing a load or preventing downward vertical displacement of inner support member 104.

As illustrated by FIG. 1, jacking pole 100 may also include locking collar 116. Locking collar 116 may also be a structural component of any desirable shape or size. Locking collar 116 may, for example, be a tubular member with a circular cross section. In some exemplary embodiments, locking collar 116 may have a cross sectional shape and dimensions substantially similar to those of outer support member 102. Locking collar 116 may be of any desirable length, such as between approximately six and approximately twenty-four inches long, and may be manufactured from any desirable material. For example, locking collar 116 may be made of any hard supportive material known in the art, such as aluminum, alloy, wood, composites, plastic, or some combination thereof. Locking collar 116 may include a threaded or partially threaded interior surface which may mate or engage with a threaded portion of outer support member 102.

Still referring to FIG. 1, jacking pole 100 may include housing 118. Housing 118 may provide a solid surface for supporting pin 108 and may also support or house various jacking mechanisms. For example, housing 118 may house jacking members 119, which may be any desirable hydraulic, pneumatic or any other extendable or movable device. Housing 118 may be coupled to outer support member 102, but not to inner support member 104, such that inner support member 104 may remain free to articulate, extend, or otherwise move. Housing 118 may include any number of individual parts, each of any desirable shape or size. For example, housing 118 may include two rectangular cuboid members with circular outer edges which may be mounted on the outer edge of outer support member 102, in dispositions substantially opposite from each other such that pin 108 may rest atop of both supports 118 simultaneously. In such an embodiment, housing 118 may include two housings which may each house a single jacking member 119. Although housed separately, jacking members 119 may function in tandem. In alternate embodiments, housing 118 may be disposed interiorly of outer support member 102, such that jacking member 119 may be disposed within outer support member 102. In such an exemplary embodiment, jacking member 119 may be disposed within outer support member 102 and inside inner support member 104.

Figure 2:
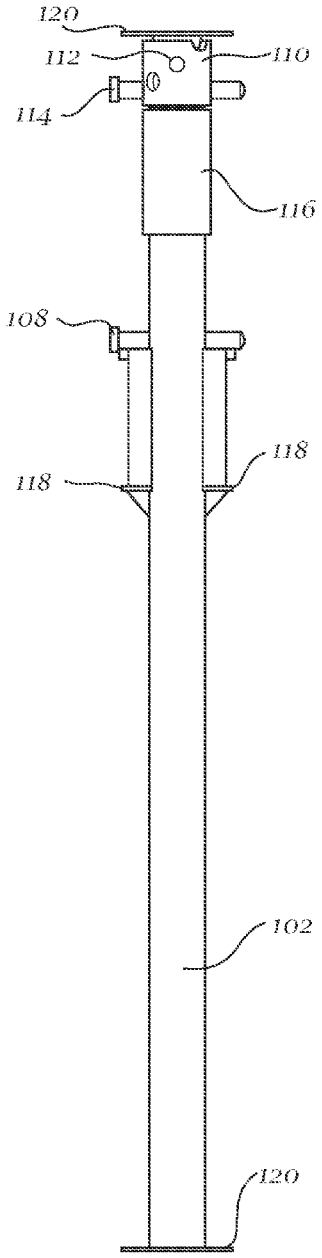
FIG. 2 is an exemplary front view of a jacking pole.
Figure 3:
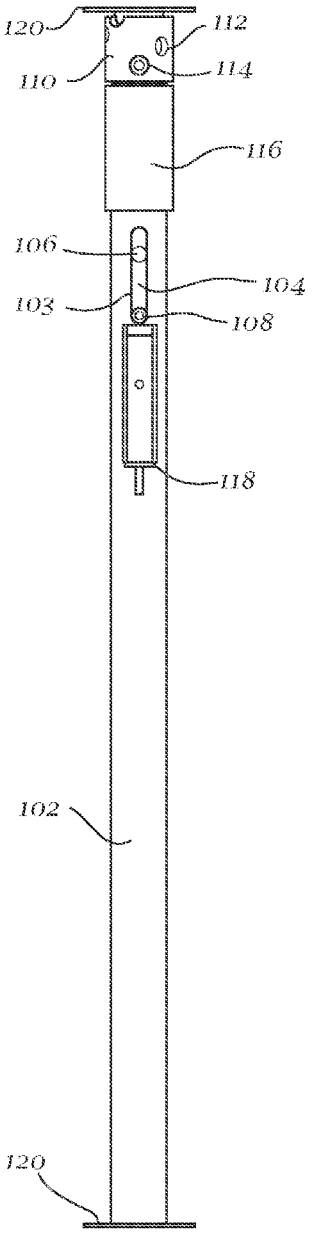
FIG. 3 is an exemplary side view of a jacking pole.

In order to facilitate engagement with surfaces and objects, jacking pole 100 may, as depicted in FIGS. 1-3, include end plates 120. End plates 120 may be any desirable shape and size, such as square planar bases measuring approximately one foot by one foot. End plates 120 may be coupled to both ends of jacking pole 100 and may allow Jacking pole 100 to engage two surfaces or objects, while extending therebetween. For example, end plates 120 may serve to support a surface disposed above jacking pole by increasing the contact area which jacking pole 100 maintains with an overhead surface. If an endplate 120 is coupled to the bottom of jacking pole 100, it may be coupled to the bottom edge of outer support member 102. In contrast, if end plate 120 is coupled to the top of jacking pole 100, it may be coupled to the top edge of inner support member 104. Thus, if jacking pole 100 extends, endplates 120 may be pushed or otherwise displaced away from each other.

As depicted in the exemplary embodiment of FIG. 1, endplates 120 may include various holes and openings to allow endplates 120 to be fastened or secured, in any desirable manner, to various surfaces, objects, or some combination thereof. For example, endplates 120 may serve to couple jacking pole 100 to a concrete floor at its bottom edge and a wooden structure at its top edge. In this exemplary configuration, jacking pole 100 may be secured to the floor while the wooden structure coupled to the top of jacking pole 100 may be raised or supported by jacking pole 100. Endplates 120 may be coupled to support members 102 and 104, as well as any surface or object, in any desirable manner, such as with bolts, screws, welding, adhesives, or some combination thereof.

Figure 4:
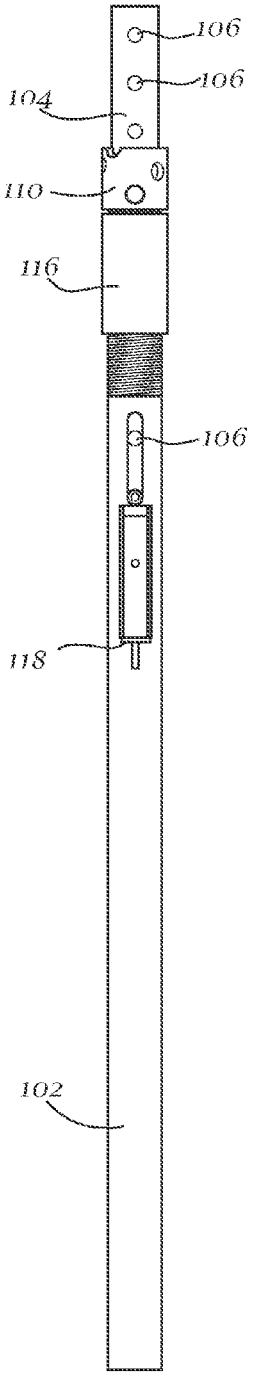
FIG. 4 is an exemplary side view of a jacking pole in a partially extended configuration.
Figure 5:
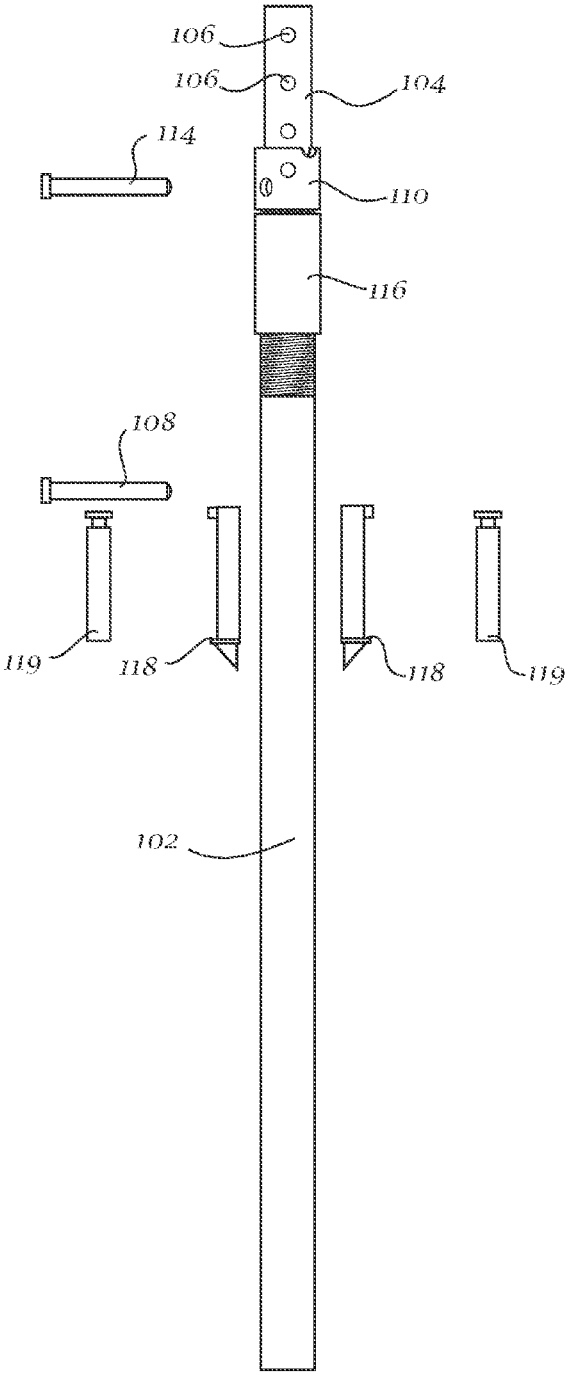
FIG. 5 is an exemplary exploded front view of a jacking pole in a partially extended configuration.

Now referring to FIGS. 4-5, jacking pole 100 may be operated by slidably extending inner support member 104 from within outer support member 102. Inner support member 104 may be raised, lowered, or otherwise extended manually or automatically, such as through hydraulic, pneumatic or mechanical actuation. Further, jacking pole, once extended, may be locked off mechanically, such as with a locking mechanism which may be a series of pins. Jacking pole 100 may extend, in some exemplary embodiments, approximately 100% of its minimal length. In some exemplary embodiments, jacking pole 100 may be manually adjusted to any desirable length. For example, if pins 108 and 114 are removed, support members 102 and 104 may be free to move or articulate in a coaxial, linear fashion, independently of each other. However, if either support member 102 or 104 is coupled to a fixed surface, removing pins 108 and 114 may serve to only allow the uncoupled support member to freely move in a linear fashion. Once jacking pole 100 is adjusted to a desirable height, pin 108, pin 114, or both pins 108 and 114 may be inserted through the appropriate holes in order to secure jacking pole 100 in the desired position. Pin 108 may be inserted through holes 106 and openings 103, while pin 114 may be inserted through holes 112 and the corresponding holes 106.

In alternate exemplary embodiments, jacking pole 100 may be raised, either manually or automatically, through a series of gradual extending movements, such as traditional "jacking" movements. However, jacking pole 100, may be extended smoothly, such as by raising jacking pole at a constant or low acceleration rate, regardless of whether it is raised through a series of steps, such as in a traditional jacking or step movement. In order to manually extend jacking pole 100, inner support member 104 may simply be lifted or pushed upwards. In contrast, jacking members 119 may serve to automatically raise jacking pole 100 incremental amounts if so desired, for example hydraulically, pneumatically, or mechanically. Additionally, jacking pole 100 may be, for example, locked off or jacked up mechanically by turning locking collar 116. In some exemplary embodiments, pin 108 may extend through and beyond support members 102 and 104 and jacking members 119 may engage pin 108 on either side. Alternatively, jacking members 119 may engage pin 108 interiorly of outer support member 102. Thus, when activated, such as pneumatically or hydraulically, jacking members 119 may push or otherwise displace pin 108 upwards at locations on either side of tubular members 102 and 104 simultaneously. Alternatively, in some exemplary embodiments, jacking pole 100 may include traditional automatic jacking means known in the art, such as, but not limited to, a spring loaded cylinder disposed beneath pin 108 which may substantially fill the inner cross section of inner support member 104. In such an exemplary configuration, the removal of pin 114 may allow the spring loaded cylinder to automatically push inner support member 104 vertically upwards a desirable amount.

When jacking pole 100 is raised incrementally, whether manually or automatically, pin 108 may remain inserted through opening 103 and holes 106, such that pin 108 may allow upwards vertical movement over the length of opening 103 while preventing downward vertical movement below the bottom of opening 103. If pin 108 is vertically displaced, it may effect vertical movement of inner support member 104 due to pin 108's engagement with inner support member 104 through holes 106. In some exemplary embodiments, inner support member 104 may be mechanically "locked off", or otherwise locked in place once it is raised in order to release pressure on the pneumatic, hydraulic or mechanical lift of jacking member 119.

In alternate exemplary embodiments, jacking members 119 may serve to automatically vertically displace pin 108, such as hydraulically, pneumatically, or mechanically, which may, in turn, move inner support member 104 in a vertical coaxial fashion until pin 108 may be disposed at the top of opening 103. For example, jacking member 119 may be automatically actuated in, for example, a pneumatic, hydraulic, or mechanical manner, each time that pin 108 contacts the lower edge of opening 103. Vertical coaxial displacement over the major axis of opening 103 may move inner support member 104 upwards a distance ranging from approximately four inches to approximately twenty-four inches. Alternatively, in other exemplary embodiments, pin 108 or pin 114 may be vertically displaced manually in order to raise or otherwise extend jacking pole 100.

In exemplary embodiments where inner support member 104 may be extended the length of opening 103, sliding collar 110 may either remain in contact with locking collar 116 or remain a fixed distance from the top of inner support member 104. The latter may occur when pin 114 remains in place while the former may occur when pin 114 is removed prior to inner support member 104's vertical articulation. Regardless of when pin 114 is removed, once inner support member 104 is displaced a desired distance, such as the length of opening 103, sliding collar 110 may be moved into a position abutting locking collar 116. Either before or after sliding collar 110 abuts locking collar 116, locking collar 116 may be adjusted a desirable amount via its threaded engagement with outer support member 102, thereby vertically displacing the ultimate disposition of sliding collar 110. In some exemplary embodiments, locking collar 116's position may be adjusted from a range of about zero inches to about twenty-four inches or more as desired, so that at least one set of holes 112 on sliding collar 110 may align with a set of holes 106 in inner support member 104 at a desirable height. However, in alternate exemplary embodiments, holes 112 may be positioned on sliding collar 110 such that locking collar 116 may only be required to be adjusted approximately one inch in order to align holes 112 with any holes 106 on inner support member 104. This may reduce the time and effort required to mechanically lock off inner support member 104 in a raised position. Once a desired hole alignment is achieved, pin 114 may be reinserted through holes 112 and holes 106 in order to secure jacking pole 100 at this heightened position.

Subsequent to reinserting pin 114, pin 108 may be removed from a first position in holes 106 and reinserted through opening 103 into a second position in holes 106, wherein the second position may be disposed substantially below the first position that pin 108 was initially removed from. While pin 108 is removed, pin 114 may support any load which jacking pole 100 is bearing and may prevent jacking pole 100 from lowering or otherwise retracting. Once pin 108 is reinserted through opening 103 and a second position in holes 106, inner support member 104 may once again be raised, such as by jacking members 119, in order to continue the process of incrementally increasing the length of jacking pole 100.

Still referring to FIGS. 4-5, jacking pole 100 may also be extended or expanded while engaged with a surface or object at either end, regardless of whether either end is coupled to an end plate 120. For example, if the bottom of jacking pole 100 is resting upon a fixed surface, while an object rests upon the top of jacking pole 100, jacking pole 100 may extend vertically in order to raise the object resting atop of jacking pole 100. Alternatively, if the top of jacking pole 100 is coupled to or abutting on a fixed object or surface, jacking pole 100 may serve to lower an object or surface. In order to vertically move an object or surface, jacking pole 100 may be extended either manually or automatically in the same manners described above. Further, it is envisioned that jacking pole 100 may be refracted in the same manner in which is extended.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. An extensible pole comprising:

a first member slidably engaged within a substantially hollow second member;

wherein at least one hole is disposed transversely in the first member and at least one hole is disposed transversely in the second member;

a locking mechanism, wherein the locking mechanism is configured to removably engage the second member and at least one hole disposed in the first member, so as to restrict sliding of the first member within the second member; and a jacking member, wherein the jacking member effectuates sliding of the first member in relation to the second member.

2. The extensible pole of claim 1 wherein the locking mechanism is at least one pin removably engaging at least one hole disposed in the first member or removably engaging at least one hole disposed in the first member and at least one hole disposed in the second member.

3. The extensible pole of claim 1 further comprising a sliding collar, the sliding collar having at least one hole disposed transversely therein.

4. The extensible pole of claim 3 wherein the locking mechanism comprises:

a first pin and a second pin;

wherein the first pin engages at least one hole of the first member and the sliding collar and the sliding collar abuts the top face of the second member;

wherein a second pin engages the first and second members.

5. The extensible pole of claim 4 wherein the first and second pins engage the first and second members and the sliding collar through the at least one hole disposed in the first and second members and the sliding collar.

6. The extensible pole of claim 4 wherein the sliding collar is slidably engaged to the first member.

7. The extensible pole of claim 4, wherein the vertical position of the sliding collar is adjusted by vertically articulating a locking collar which is threadably engaged to the second tubular member.

8. The extensible pole of claim 1 wherein the openings in the first tubular member are holes selectively placed at various positions along its length, such that the holes may be engaged by the locking mechanisms.

9. The extensible pole of claim 1 wherein the openings in the second tubular member are two ovular openings corresponding with the openings in the first tubular member.

10. The extensible pole of claim 1 further comprising end plates which are coupled to a first end of the first tubular member and the opposite end of the second tubular member.

11. The extensible pole of claim 1, wherein the jacking member is at least one of pneumatically, hydraulically, or mechanically actuated to effectuate smooth vertical coaxial articulation.

12. An extensible pole comprising:

a first member slidably engaged with a second member, so as to extend therefrom, wherein both members include at least one hole disposed transversely therein; and a locking mechanism configured to restrict the sliding of the first member in at least one direction within the second member, wherein the locking mechanism removably engages the at least one hole disposed in the first member or removably engages the at least one hole disposed in the first member and the at least one hole disposed in the second member.

13. The extensible pole of claim 12 wherein the at least one hole disposed in the second member is elongated, so as to allow the first member to slide the length of the at least one hole in the second member while the locking mechanism is engaged in the at least one hole disposed in the first member.

14. The extensible pole of claim 12 wherein the locking mechanism is at least one pin configured to engage the at least one hole disposed in the first member.

15. The extensible pole of claim 12 further comprising a locking collar, wherein the locking collar is adjustably affixed to an end of the second member from which the first member extends, wherein the locking collar is configured to engage at least one of the locking mechanism or a sliding collar.

16. The extensible pole of claim 15 wherein the locking collar is threadably affixed to the second member.

17. The extensible pole of claim 12 further comprising a sliding collar, wherein the sliding collar is slidably engaged around the first member and is capable of abutting an end of the second member or a locking collar, wherein the sliding collar has at least one hole transversely disposed therein.

18. The extensible pole of claim 12 further comprising a jacking member configured to effectuate sliding of the first member in relation to the second member.

19. The extensible pole of claim 12 further comprising end plates which are coupled to a first end of the first tubular member and the opposite end of the second tubular member.

* * * * *